US011560870B2

(12) United States Patent
Sim et al.

(10) Patent No.: US 11,560,870 B2
(45) Date of Patent: Jan. 24, 2023

(54) IGNITION COIL CONTROL SYSTEM AND METHOD THEREOF

(71) Applicants: Hyundai Motor Company, Seoul (KR); Kia Corporation, Seoul (KR)

(72) Inventors: Kiseon Sim, Suwon-Si (KR); Dongwon Jung, Gwacheon-Si (KR); Won Gyu Kim, Seoul (KR); Jin Oh Song, Hwaseong-Si (KR); Soo Hyung Woo, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/486,422

(22) Filed: Sep. 27, 2021

(65) Prior Publication Data

US 2022/0252033 A1 Aug. 11, 2022

(30) Foreign Application Priority Data

Feb. 5, 2021 (KR) ..... 10-2021-0016579

(51) Int. Cl.
*F02P 15/00* (2006.01)
*F02P 15/08* (2006.01)
(Continued)

(52) U.S. Cl.
CPC ..... *F02P 15/008* (2013.01); *F02P 3/045* (2013.01); *F02P 3/0453* (2013.01);
(Continued)

(58) Field of Classification Search
None
See application file for complete search history.

(56) References Cited

U.S. PATENT DOCUMENTS 4,839,772 A * 6/1989 Choi ..... F02P 3/0884 361/263
4,922,874 A * 5/1990 DeBiasi ..... F02P 5/1518 701/115

(Continued)

FOREIGN PATENT DOCUMENTS

CN 107709757 A * 2/2018 ..... F02P 15/00
DE 102012106207 B3 * 5/2013 ..... F02B 75/18

(Continued)

*Primary Examiner* — Kevin R Steckbauer
(74) *Attorney, Agent, or Firm* — Morgan, Lewis & Bockius LLP

(57) ABSTRACT

An ignition coil control system may include a first ignition coil including a primary coil and a secondary coil; a first switch that selectively electrically-connects the primary coil of the first ignition coil; a second ignition coil including a primary coil and a secondary coil; a second switch that selectively electrically-connects the primary coil of the second ignition coil; a pair of electrodes generating spark discharge by a discharge current generated in the first ignition coil and the second ignition coil; and an ignition controller that controls spark discharge of the pair of electrodes by adjusting an amount and a duration of the discharge current of the first ignition coil and the second ignition coil by turning the first switch and the second switch on or off according to a single pulse signal having a constant voltage including different voltages transmitted from an engine control unit (ECU).

4 Claims, 5 Drawing Sheets

(51) Int. Cl.
*F02P 15/10* (2006.01)
*F02P 3/05* (2006.01)
*F02P 3/045* (2006.01)

(52) U.S. Cl.
CPC ..... *F02P 3/0456* (2013.01); *F02P 3/05* (2013.01); *F02P 15/08* (2013.01); *F02P 15/10* (2013.01)

(56) References Cited

U.S. PATENT DOCUMENTS 5,044,348 A * 9/1991 Ookawa ..... F02P 15/08 123/655
5,097,815 A * 3/1992 Oota ..... F02P 3/0435 315/209 T
5,140,970 A * 8/1992 Akaki ..... F02P 15/008 123/620
5,193,515 A * 3/1993 Oota ..... F02P 15/10 123/620
5,197,449 A * 3/1993 Okamoto ..... F02P 3/0453 123/622
5,301,502 A * 4/1994 Oota ..... F01N 3/32 60/284
5,875,763 A * 3/1999 Mottier ..... F02P 15/008 123/406.55
5,886,476 A * 3/1999 Skinner ..... F02P 9/007 315/209 T
5,947,093 A * 9/1999 Ward ..... F02P 3/08 123/620
6,352,069 B1 * 3/2002 Kraus ..... H01F 38/12 123/622
6,701,904 B2 * 3/2004 Lepley ..... F02P 3/0846 123/620
7,021,299 B2 * 4/2006 Torrisi ..... F02P 3/0442 123/620
7,681,562 B2 * 3/2010 Boerjes ..... F02P 3/053 123/622
7,836,869 B2 * 11/2010 Boerjes ..... F02P 3/053 123/622
8,286,617 B2 * 10/2012 Grady ..... F02P 3/04 123/622
8,813,732 B2 * 8/2014 Kataoka ..... F02P 15/10 123/621
9,341,155 B2 * 5/2016 Kurahashi ..... F02P 15/10
9,429,134 B2 * 8/2016 Desai ..... F02P 9/007
9,458,773 B2 * 10/2016 Glugla ..... F02P 5/045
9,458,816 B2 * 10/2016 Aida ..... F02P 15/00
9,531,165 B2 * 12/2016 Ruan ..... F02P 3/0407
9,605,644 B2 * 3/2017 Huberts ..... F02P 3/04
9,695,792 B2 * 7/2017 Huberts ..... F02P 3/05
9,932,954 B2 * 4/2018 Nakamura ..... F02P 5/00
10,006,432 B2 * 6/2018 Desai ..... F02P 3/045
10,041,463 B2 * 8/2018 Toriyama ..... F02P 15/10
10,113,526 B2 * 10/2018 Takeda ..... F02P 15/00
10,167,839 B2 * 1/2019 Inada ..... F02P 3/0407
10,190,564 B2 * 1/2019 Ruan ..... F02P 3/0435
10,294,910 B2 * 5/2019 Sugita ..... F02P 3/04
10,302,061 B2 * 5/2019 Terada ..... F02P 15/008
10,309,366 B2 * 6/2019 Seimiya ..... F02P 3/05
10,502,176 B2 * 12/2019 Czekala ..... F02P 3/04
10,648,444 B2 * 5/2020 Lorenz ..... F02P 15/10
10,788,006 B2 * 9/2020 Lorenz ..... F02P 15/10
10,844,825 B2 * 11/2020 Lorenz ..... F02P 15/10
10,859,057 B2 * 12/2020 Ohno ..... F02P 3/0407
10,947,947 B2 * 3/2021 Tanaya ..... F02P 5/145
11,125,201 B2 * 9/2021 Terada ..... F02P 11/00
11,378,055 B1 * 7/2022 Sim ..... F02P 3/02
2002/0170547 A1 * 11/2002 Lepley ..... F02P 3/08 123/620
2009/0194083 A1 * 8/2009 Boerjes ..... F02P 3/053 123/622
2012/0017881 A1 * 1/2012 Kataoka ..... F02P 3/051 123/621
2012/0055455 A1 * 3/2012 Ruan ..... F02P 23/04 123/608
2012/0160222 A1 * 6/2012 Grady ..... F02P 3/0453 123/622
2012/0186569 A1 * 7/2012 Shimakawa ..... F02P 15/10 123/644
2013/0241429 A1 * 9/2013 Ruan ..... F02P 3/0456 315/213
2014/0102412 A1 * 4/2014 Czekala ..... F02P 3/045 123/406.12
2014/0360476 A1 * 12/2014 Huberts ..... F02P 9/002 315/220
2015/0152832 A1 * 6/2015 Desai ..... F02P 9/002 123/625
2015/0192100 A1 * 7/2015 Kurahashi ..... F02P 11/00 315/210
2015/0330290 A1 * 11/2015 Glugla ..... F02D 19/081 123/298
2016/0348634 A1 * 12/2016 Desai ..... F02P 3/045
2017/0022959 A1 * 1/2017 Huberts ..... F02P 11/02
2017/0022961 A1 * 1/2017 Toriyama ..... F02P 3/08
2017/0067434 A1 * 3/2017 Ruan ..... H01T 15/00
2017/0284356 A1 * 10/2017 Takeda ..... F02P 9/007
2017/0292492 A1 * 10/2017 Inada ..... H01T 13/20
2018/0258901 A1 * 9/2018 Terada ..... F02P 15/08
2019/0128234 A1 * 5/2019 Tanaya ..... F02P 5/145
2019/0162155 A1 * 5/2019 Frank ..... F02P 3/053
2019/0301421 A1 * 10/2019 Lorenz ..... F02P 9/00
2019/0301422 A1 * 10/2019 Lorenz ..... F02P 15/10
2021/0102521 A1 * 4/2021 Terada ..... F02P 17/12
2022/0252033 A1 * 8/2022 Sim ..... F02P 3/0453
2022/0275782 A1 * 9/2022 Sim ..... F02P 3/045

FOREIGN PATENT DOCUMENTS

DE 102013111299 A1 * 4/2014 ..... F02P 3/04
DE 112016002134 T5 * 1/2018 ..... F02P 15/00
GB 2069044 A * 8/1981 ..... F02P 15/12
JP 3103852 B2 * 10/2000 ..... F02P 15/008
JP 2016211446 A * 12/2016 ..... F02P 15/00
RU 145341 U1 * 9/2014 ..... F02P 3/04
WO WO-2016181971 A1 * 11/2016 ..... F02P 15/00

* cited by examiner

IGNITION COIL CONTROL SYSTEM AND METHOD THEREOF

CROSS-REFERENCE TO RELATED APPLICATION

The present application claims priority to Korean Patent Application No. 10-2021-0016579 filed on Feb. 5, 2021, the entire contents of which is incorporated herein for all purposes by this reference.

BACKGROUND OF THE INVENTION

Field of the Invention

The present invention relates to an ignition coil control system and method, and more particularly, to an ignition coil control system and method which may supply a current to an electrode of a spark plug through two ignition coils.

Description of Related Art

In gasoline vehicles, a mixture of air and fuel is ignited by a spark generated by a spark plug to be combusted. That is, the air-fuel mixture injected into a combustion chamber during a compression stroke is ignited by a discharge phenomenon of the spark plug, and thus energy required for vehicle's driving is generated while undergoing a high temperature and high pressure expansion process.

The spark plug provided in the gasoline vehicle serves to ignite a compressed air-fuel mixture by spark discharge caused by a high voltage current generated by an ignition coil.

In a spark plug mounted on a conventional gasoline vehicle, spark discharge between a pair of electrodes (a center electrode and a ground electrode) is generated by the high voltage current induced from the ignition coil, and in the instant case, difficulties exist in controlling an ignition timing and/or discharge period of the spark plug according to an operational condition of an engine.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an ignition coil control system and method which may variously control an ignition timing and discharge period of spark discharge generated between a pair of electrodes.

An ignition coil control system according to various exemplary embodiments of the present invention may include a first ignition coil including a primary coil and a secondary coil; a first switch that selectively electrically-connects the primary coil of the first ignition coil; a second ignition coil including a primary coil and a secondary coil; a second switch that selectively electrically-connects the primary coil of the second ignition coil; a pair of electrodes generating spark discharge by a discharge current generated in the first ignition coil and the second ignition coil; and an ignition controller that is connected to the first switch and the second switch and is configured to control the spark discharge of the pair of electrodes by adjusting an amount and a duration of the discharge current of the first ignition coil and the second ignition coil by turning the first switch and the second switch on or off according to a single pulse signal having a constant voltage including different voltages transmitted from an engine control unit (ECU).

The ignition controller may charge the first ignition coil by turning off the first switch when the single pulse signal is on, discharge the first ignition coil by turning off the first switch when a first dwell time elapse, charge the second ignition coil for the first dwell time by turning on the second switch when a delay time elapses from a time point at which the single pulse signal is on and the discharge it, charge the first ignition coil by turning on the first switch for a second dwell time after the second ignition coil is discharged and discharge it, and charge the second ignition coil by turning on the second switch for the second dwell time after the first ignition coil and discharge it.

The first dwell time may be determined as a time for which the first ignition coil and the second ignition coil are fully charged.

The ignition controller may repeat charging and discharging of the first ignition coil and the second ignition coil until the single pulse signal is off.

After the first ignition coil is initially discharged, a discharging period of the first ignition coil and a discharging period of the second ignition coil may overlap.

An ignition coil control method that includes a spark plug that generates spark discharge between a center electrode and a ground electrode through a current generated in a first ignition coil and a second ignition coil according to various exemplary embodiments of the present invention, the ignition coil control method may include receiving a single pulse signal having a constant voltage; charging the first ignition coil when the single pulse signal is on; charging the second ignition coil when a delay time elapses from a time point at which the single pulse signal is on; discharging the first ignition coil when a first dwell time elapses from a time point at which the single pulse signal is on; discharging the second ignition coil when the first dwell time elapses from a time point at which the second ignition coil is charged; charging the first ignition coil for a second dwell time after the second ignition coil and discharging the first ignition coil; and charging the second ignition coil for the second dwell time after the first ignition coil is discharged and discharging the second ignition coil.

The first dwell time may be determined as a time for which the first ignition coil and the second ignition coil are fully charged.

Charging and discharging of the first ignition coil and the second ignition coil may be repeated until the single pulse signal is off.

After the first ignition coil is initially discharged, a discharging period of the first ignition coil and a discharging period of the second ignition coil may overlap.

According to the ignition coil control system and method according to the exemplary embodiments of the present invention as described above, it is possible to accurately control, by controlling charging and discharging of two ignition coils by use of a single pulse signal having constant voltage transmitted from an engine control unit, an ignition timing in a combustion chamber through spark discharge generated between a center electrode and a ground electrode.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
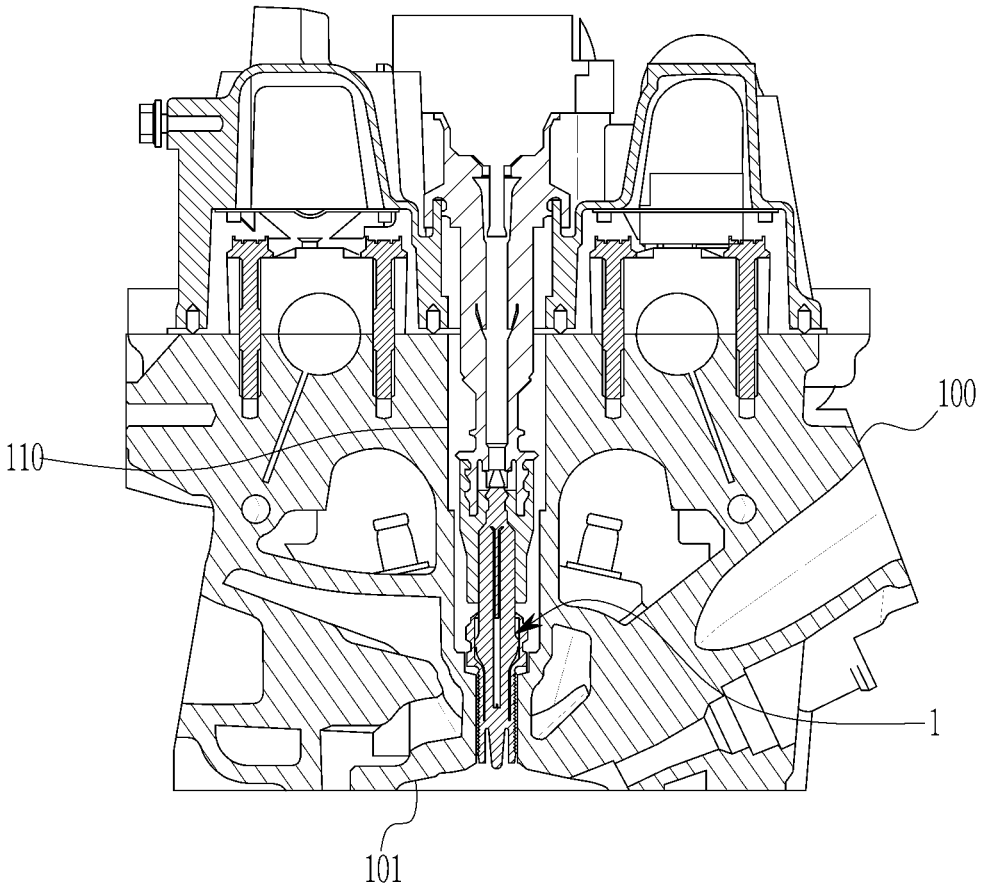
FIG. 1 illustrates a cross-sectional view of an engine in which a spark plug is mounted according to various exemplary embodiments of the present invention.

It may be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present application will be described more fully hereinafter with reference to the accompanying drawings, in which exemplary embodiments of the present invention are shown. As those skilled in the art would realize, the described embodiments may be modified in various different ways, all without departing from the spirit or scope of the present invention.

To clearly describe the present invention, parts that are irrelevant to the description are omitted, and identical or similar constituent elements throughout the specification are denoted by the same reference numerals.

Furthermore, since the size and thickness of each configuration shown in the drawings are arbitrarily shown for convenience of description, the present invention is not necessarily limited to configurations illustrated in the drawings, and in order to clearly illustrate several parts and areas, enlarged thicknesses are shown.

Hereinafter, a control system of an ignition coil according to various exemplary embodiments of the present invention will be described in detail with reference to the accompanying drawings.

FIG. 1 illustrates a cross-sectional view of an engine in which a spark plug is mounted according to various exemplary embodiments of the present invention.

As shown in FIG. 1, a spark plug 1 according to various exemplary embodiments of the present invention is mounted on a cylinder of an engine, and generates spark discharge.

The engine to which the spark plug 1 is applied includes a cylinder block and a cylinder head 100, and the cylinder block and the cylinder head 100 are combined to form a combustion chamber 101 therein. An air and fuel mixture inflowing into the combustion chamber 101 is ignited by spark discharge generated by the spark plug 1.

In the cylinder head 100, a mount hole 110 in which the spark plug 1 is mounted is vertically formed long. A lower portion of the spark plug 1 which is mounted in the mount hole 110 protrudes into the combustion chamber 101. A center electrode 2 and a ground electrode 3 that are electrically connected to an ignition coil are formed at the lower portion of the spark plug 1, and the spark discharge is generated between the center electrode 2 and the ground electrode 3.

Figure 2:
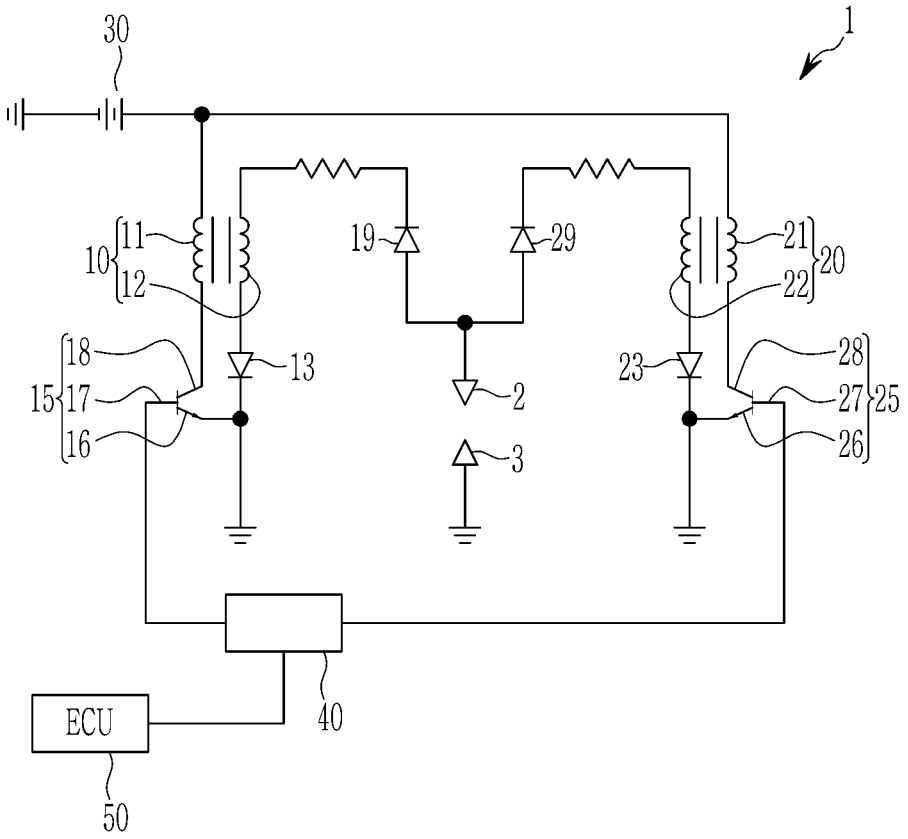
FIG. 2 illustrates a schematic view of an ignition coil control system according to various exemplary embodiments of the present invention.

FIG. 2 illustrates a schematic view of an ignition coil control system according to various exemplary embodiments of the present invention.

As shown in FIG. 2, an ignition coil control system according to various exemplary embodiments of the present invention may include an ignition controller 40 that adjusts amounts and durations of discharge currents of two ignition coils (a first ignition coil 10 and a second ignition coil 20) based on a single pulse signal having constant voltage transmitted from an engine control unit 50 that controls an overall operation of an engine to control spark discharge generated at the electrodes.

The first ignition coil 10 includes a primary coil 11 and a secondary coil 12, one end portion of the primary coil 11 is electrically connected to a battery 30 of a vehicle, and the other end portion of the primary coil 11 is grounded through a first switch 15. According to an on/off operation of the first switch 15, the primary coil 11 of the first ignition coil 10 may be selectively electrically connected.

The first switch 15 may be realized with a transistor switch (for example, an insulated gate bipolar transistor (IGBT)) including an emitter terminal 16, a collector terminal 18, and a base terminal 17. That is, the other end portion of the primary coil 11 may be electrically connected to the collector terminal 18 of the first switch 15, the emitter terminal 16 thereof may be grounded, and the base terminal 17 thereof may be electrically connected to the ignition controller 40.

One end portion of the secondary coil 12 is electrically connected to the center electrode 2, and the other end portion thereof is electrically connected to the emitter terminal 16 of the first switch 15. A diode 13 is provided between the secondary coil 12 and the emitter terminal 16 to block a current from flowing from the secondary coil 12 to the emitter terminal 16.

Furthermore, a diode 19 is provided between the secondary coil 12 and the center electrode 2, so that a current flows only from the secondary coil 12 to the center electrode 2.

When a control signal is applied to the base terminal 17 of the first switch 15 by the ignition controller 40, the primary coil 11 of the first ignition coil 10 is electrically connected, and electrical energy is charged to the primary coil 11. When no control signal is applied to the base terminal 17 of the first switch 15 by the ignition controller 40, a high voltage current (or discharge current) is generated in the secondary coil 12 due to electromagnetic induction of the primary coil 11 and the secondary coil 12. The discharge current generated in the secondary coil 12 flows to the center electrode 2, and while spark discharge being generated between the center electrode 2 and the ground electrode 3 by the discharge current generated in the secondary coil 12, an air-fuel mixture inside the combustion chamber 101 is ignited.

That is, the ignition controller 40 charges or discharges the first ignition coil 10 by turning on/off the first switch 15. When the ignition controller 40 applies a control signal to the base terminal 17 of the first switch 15 (or when the switch is turned on), the primary side coil 11 is charged (or the first ignition coil is charged).

Furthermore, when the ignition controller 40 does not apply a control signal to the base terminal 17 of the first switch 15 (or when the first switch is turned off), a high voltage current is generated in the secondary coil 12 due to electromagnetic induction with the primary coil 11, and spark discharge is generated between the center electrode 2 and the ground electrode 3 (or the first ignition coil is discharged) by the high voltage current generated in the secondary coil 12.

Like the first ignition coil 10, the second ignition coil 20 includes a primary coil 21 and a secondary coil 22, one end portion of the primary coil 21 is electrically connected to the battery 30 of the vehicle, and the other end portion of the primary coil 21 is grounded through a second switch 25. According to an on/off operation of the second switch 25, the primary coil 21 of the second ignition coil 20 may be selectively electrically connected.

The second switch 25 may be realized with a transistor switch (for example, an insulated gate bipolar transistor (IGBT)) including an emitter terminal 26, a collector terminal 28, and a base terminal 27. That is, the other end portion of the primary coil 21 may be electrically connected to the collector terminal 28 of the second switch 25, the emitter terminal 26 thereof may be grounded, and the base terminal 27 thereof may be electrically connected to the ignition controller 40.

One end portion of the secondary coil 22 is electrically connected to the center electrode 2, and the other end portion thereof is electrically connected to the emitter terminal 26 of the second switch 25. A diode 23 is provided between the secondary coil 22 and the emitter terminal 26 to block a current from flowing from the secondary coil 22 to the emitter terminal 26.

Furthermore, the diode 23 is provided between the secondary coil 22 and the center electrode 2, so that a current flows only from the secondary coil 22 to the center electrode 2.

When a control signal is applied to the base terminal 27 of the second switch 25 by the ignition controller 40, the primary coil 21 of the second ignition coil 20 is electrically connected, and electrical energy is charged to the primary coil 21. When no control signal is applied to the base terminal 27 of the second switch 25 by the ignition controller 40, a high voltage current (or discharge current) is generated in the secondary coil 22 due to electromagnetic induction of the primary coil 21 and the secondary coil 22. The discharge current generated in the secondary coil 22 flows to the center electrode 2, and while spark discharge being generated between the center electrode 2 and the ground electrode 3 by the discharge current generated in the secondary coil 22, an air-fuel mixture inside the combustion chamber 101 is ignited.

That is, the ignition controller 40 charges or discharges the second ignition coil 20 by turning the second switch 25 on/off. When the ignition controller 40 applies a control signal to the base terminal 27 of the second switch 25 (or when the switch is turned on), the primary side coil 21 is charged (or the second ignition coil is charged).

Furthermore, when the ignition controller 40 does not apply a control signal to the base terminal 27 of the second switch 25 (or when the second switch is turned off), a high voltage current is generated in the secondary coil 22 due to electromagnetic induction with the primary coil 21, and spark discharge is generated between the center electrode 2 and the ground electrode 3 (or the second ignition coil is discharged) by the high voltage current generated in the secondary coil 22.

In the specification of the present invention, charging the primary coil of the first ignition coil 10 by turning on the first switch 15 is referred to as charging the first ignition coil 10, and a high voltage current is induced to the secondary coil of the first ignition coil 10 by turning off the first switch 15 and thus spark discharge occurs between the center electrode 2 and the ground electrode 3 is referred to as the first ignition coil 10 being discharged.

Likewise, charging the primary coil of the second ignition coil 20 by turning on the second switch 25 is referred to as charging the second ignition coil 20, and a high voltage current is induced to the secondary coil of the second ignition coil 20 by turning off the second switch 25 and thus spark discharge occurs between the center electrode 2 and the ground electrode 3 is referred to as the second ignition coil 20 being discharged.

The ignition coil control system according to the exemplary embodiment of the present invention controls the charging and discharging of the two ignition coils based on the single pulse signal transmitted from the engine control unit 50, so that it is possible to accurately control the ignition timing of the spark discharge generated between the center electrode 2 and the ground electrode 3.

To the present end, the ignition controller 40 may be provided as at least one processor executed by a predetermined program, and the predetermined program is configured to perform respective steps of a control method of the spark plug 1 according to various exemplary embodiments of the present invention.

Hereinafter, the operation of the ignition coil control system according to the exemplary embodiment of the present invention as described above will be described in detail with reference to the accompanying drawings.

Figure 3:
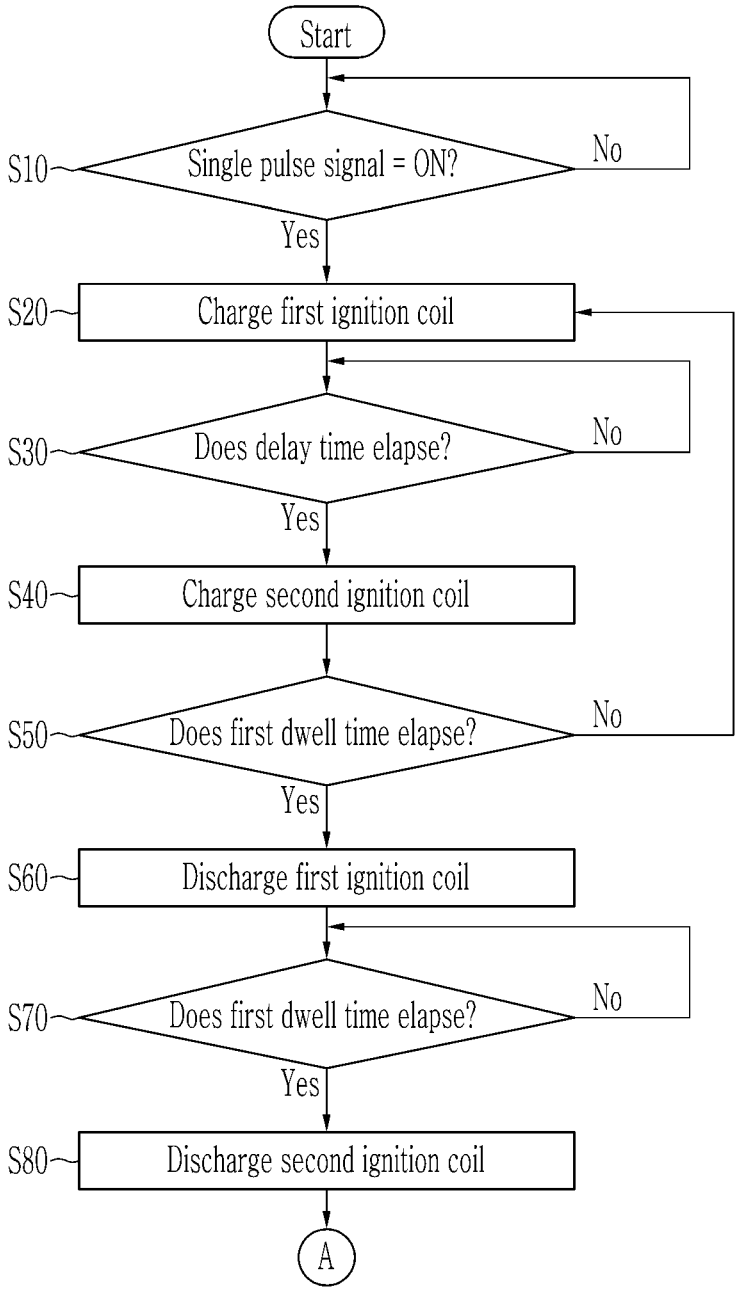
FIG. 3 and FIG. 4 illustrate flowcharts of an ignition coil control method according to various exemplary embodiments of the present invention.
Figure 4:
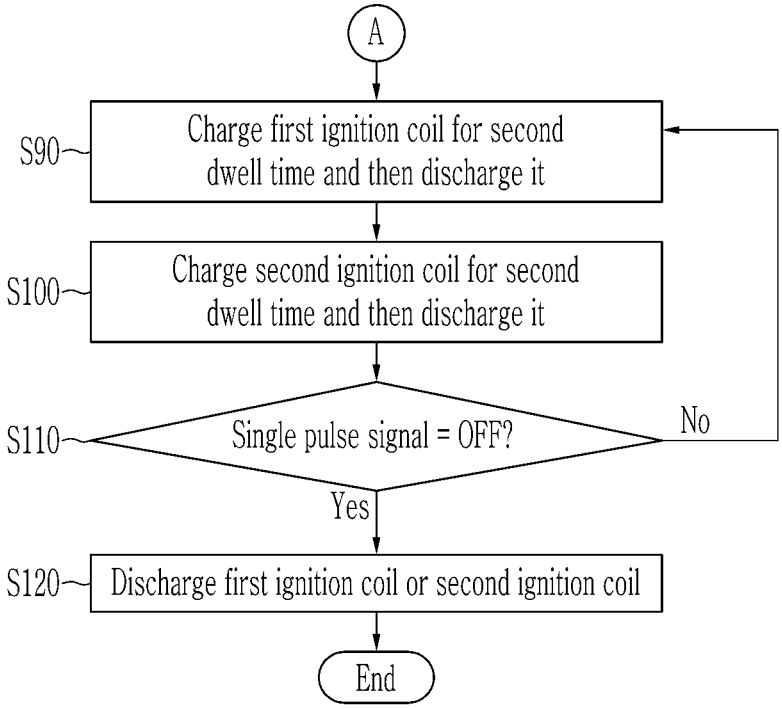

FIG. 3 and FIG. 4 illustrate flowcharts of an ignition coil control method according to various exemplary embodiments of the present invention. Furthermore, FIG. 5 illustrates an operation of two ignition coils according to various exemplary embodiments of the present invention.

Figure 5:
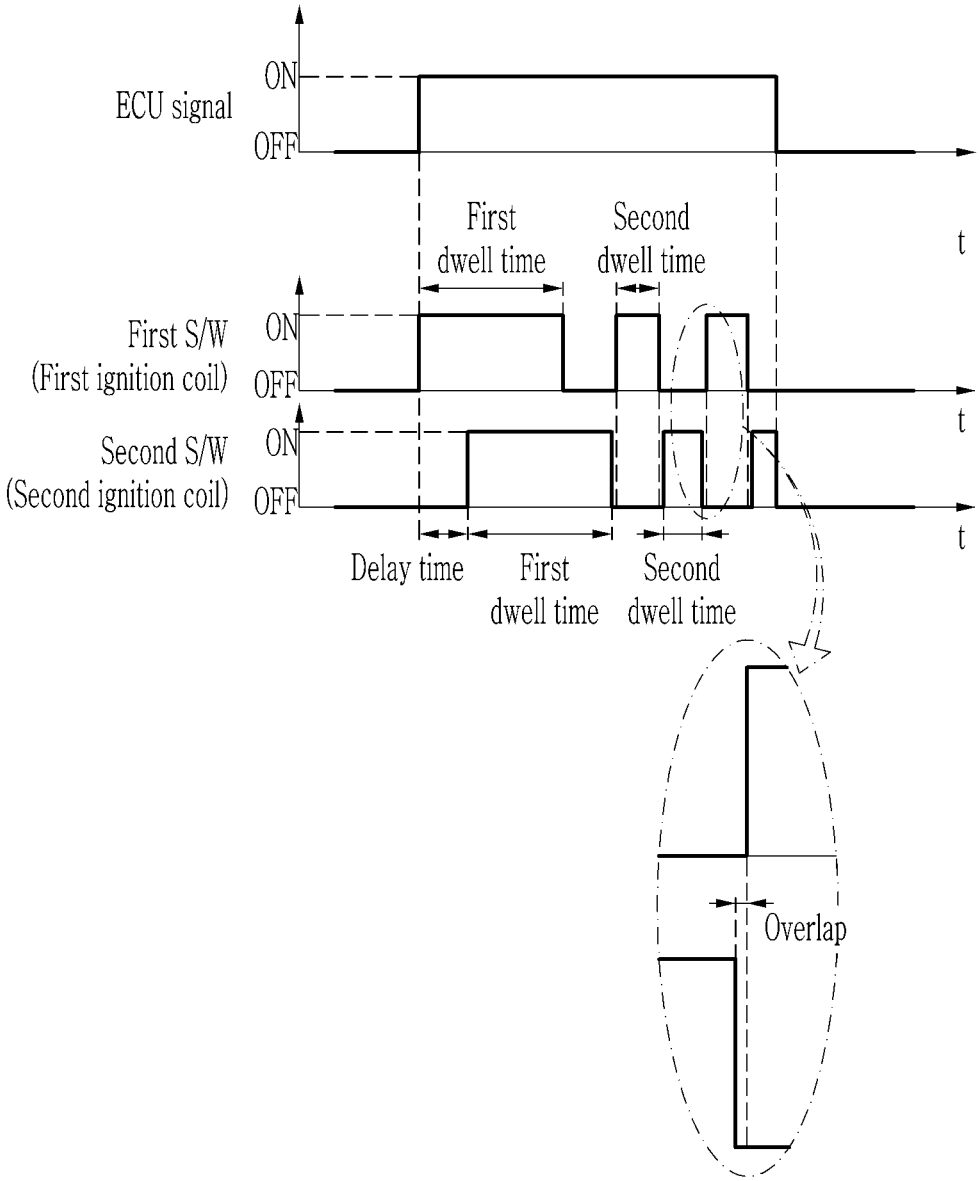
FIG. 5 illustrates an operation of two ignition coils according to various exemplary embodiments of the present invention.

As shown in FIG. 3 to FIG. 5, the engine control unit (ECU) 50 transmits a pulse signal (or ECU signal) to the ignition controller 40 to ignite the air-fuel mixture inflowing into the combustion chamber 101 during an explosion stroke of the engine. In the instant case, the pulse signal transmitted from the engine control unit 50 to the ignition controller 40 may be a single pulse signal having constant voltage (e.g., 12V) and a predetermined period.

When the single pulse signal is transmitted from the engine control unit 50, the ignition controller 40 charges and then discharges the first ignition coil 10 in synchronization with the single pulse signal. That is, when the single pulse signal is on (S10), the ignition controller 40 turns on the first switch 15 to charge the first ignition coil 10 (S20).

When a predetermined delay time elapses from the time point at which the single pulse signal is on (S30), the ignition controller 40 turns on the second switch 25 to charge the second ignition coil 20 (S40).

When a first dwell time elapses from the time point at which the single pulse single is on (S50), the ignition controller 40 discharges the first ignition coil 10 by turning off the first switch 15 (S60). Herein, the first dwell time may be a time during which the first ignition coil 10 and the second ignition coil 10 are fully charged. In the instant case, the time during which the first ignition coil 10 and the second ignition coil 20 are fully charged may be changed according to the output voltage of the battery 30. For example, when the output voltage of the battery 30 is high, the first dwell time may be shortened, and when the output voltage of the battery 30 is low, the first dwell time may be lengthened.

When the first dwell time elapses from the charging time point of the second ignition coil 20 (S70), the ignition controller 40 discharges the second ignition coil 20 by turning off the second switch 25 (S80).

After the second ignition coil 20 is discharged, the ignition controller 40 charges the first ignition coil 10 by turning of the first switch 15 for a second dwell time and then discharges it (S90). Here, the second dwell time may be set to be shorter than the first dwell time.

After the first ignition coil 10 is discharged, the ignition controller 40 charges the second ignition coil 20 by turning of the second switch 25 for the second dwell time and then discharges it (S100).

In the instant case, after the first ignition coil 10 is initially discharged, the ignition controller 40 adjusts the charging timing and discharging timing of the first ignition coil 10, and the charging timing and discharging timing of the second ignition coil 20, so that a charging period of the first ignition coil 10 and a charging period of the second ignition coil 20 do not overlap. In other words, after the first ignition coil 10 is initially discharged, the discharging period of the first ignition coil 10 and the discharging period of the second ignition coil 20 may overlap.

As described above, when the discharging period of the first ignition coil 10 and the discharging period of the second ignition coil 20 overlap, the spark discharge is continuously generated between the center electrode 2 and the ground electrode 3, and ignition energy may be efficiently transmitted to the air-fuel mixture in the combustion chamber 101. Therefore, the discharge efficiency of the spark plug 1 may be improved.

When the single pulse signal is off (S110), the ignition controller 40 discharges the first ignition coil 10 or the second ignition coil 20 (S120). For example, when the step pulse signal is off while the first ignition coil 10 is being charged, the ignition controller 40 discharges the first ignition coil 10 when the step pulse signal is off. Furthermore, when the step pulse signal is off while the second ignition coil 20 is being charged, the ignition controller 40 discharges the second ignition coil 20 when the step pulse signal is off.

According to the spark plug 1 according to the exemplary embodiment of the present invention as described above, by controlling the charging and discharging of the two ignition coils by use of the single pulse signal having constant voltage transmitted from the engine control unit 50, the ignition timing in the combustion chamber 101 through the spark discharge generated between the center electrode 2 and the ground electrode 3 may be accurately controlled.

Furthermore, by use of the single pulse signal transmitted from the engine control unit 50, the multi-stage ignition of the spark plug may be easily controlled. That is, by fully charging and then discharging the first ignition coil 10 and the second ignition coil 20 by use of the time point at which the single pulse signal is on and the first dwell time, sufficient ignition energy may be supplied into the combustion chamber 101. Furthermore, multi-stage ignition may be easily implemented by repeating the charging and discharging of the first ignition coil 10 and the second ignition coil 20 based on the second dwell time and the time point at which the single pulse signal is off.

Through this, the initial combustion speed is prevented from increasing, and knocking is prevented, so that the engine output and fuel economy may be improved. Furthermore, even when the ignition property of the air-fuel mixture is degraded, such as when exhaust gas recirculation (EGR) gas is supplied to the combustion chamber 101 of the engine or a lean combustion occurs, sufficient ignition energy may be supplied into the combustion chamber 101.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The control device according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method included in the aforementioned various exemplary embodiments of the present invention.

The aforementioned invention can also be embodied as computer readable codes on a computer readable recording medium. The computer readable recording medium is any data storage device that can store data which may be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet).

In various exemplary embodiments of the present invention, each operation described above may be performed by a control device, and the control device may be configured by a plurality of control devices, or an integrated single control device.

In various exemplary embodiments of the present invention, the control device may be implemented in a form of hardware or software, or may be implemented in a combination of hardware and software.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An ignition coil control system comprising:

a first ignition coil including a primary coil and a secondary coil;

a first switch that selectively electrically-connects the primary coil of the first ignition coil;

a second ignition coil including a primary coil and a secondary coil;

a second switch that selectively electrically-connects the primary coil of the second ignition coil;

a pair of electrodes generating spark discharge by a discharge current generated in the first ignition coil and the second ignition coil; and an ignition controller that is connected to the first switch and the second switch and is configured to control the spark discharge of the pair of electrodes by adjusting an amount and a duration of the discharge current of the first ignition coil and the second ignition coil by turning the first switch and the second switch on or off according to a single pulse signal having a constant voltage transmitted from an engine control unit (ECU), wherein the ignition controller is configured for:

charging the first ignition coil by turning on the first switch when the single pulse signal is on;

discharging the first ignition coil by turning off the first switch when a first dwell time elapse;

charging the second ignition coil for the first dwell time by turning on the second switch when a delay time elapses from a time point at which the single pulse signal is on and then discharging the second ignition coil;

charging the first ignition coil by turning on the first switch for a second dwell time after the second ignition coil is discharged and discharging the first ignition coil; and charging the second ignition coil by turning on the second switch for the second dwell time after the first ignition coil is discharged and discharging the second ignition coil, and wherein the ignition controller is configured to repeat the charging and the discharging of the first ignition coil and the second ignition coil until the single pulse signal is off, and wherein after the first ignition coil is initially discharged, a discharging period of the first ignition coil and a discharging period of the second ignition coil overlap.

2. The ignition coil control system of claim 1, wherein the first dwell time is a time for which the first ignition coil and the second ignition coil are fully charged.

3. A method of controlling an ignition coil control system including a spark plug that generates spark discharge between a center electrode and a ground electrode through a current generated in a first ignition coil and a second ignition coil, the control method comprising:

receiving, by a controller, a single pulse signal having a constant voltage;

charging, by the controller, the first ignition coil when the single pulse signal is on;

charging, by the controller, the second ignition coil when a delay time elapses from a time point at which the single pulse signal is on;

discharging, by the controller, the first ignition coil when a first dwell time elapses from a time point at which the single pulse signal is on;

discharging, by the controller, the second ignition coil when the first dwell time elapses from a time point at which the second ignition coil is charged;

charging, by the controller, the first ignition coil for a second dwell time after the second ignition coil and discharging, by the controller, the first ignition coil; and charging, by the controller, the second ignition coil for the second dwell time after the first ignition coil is discharged and discharging, by the controller, the second ignition coil, wherein the charging and the discharging of the first ignition coil and the second ignition coil are repeated until the single pulse signal is off, and wherein after the first ignition coil is initially discharged, a discharging period of the first ignition coil and a discharging period of the second ignition coil overlap.

4. The method of claim 3, wherein the first dwell time is a time for which the first ignition coil and the second ignition coil are fully charged.

* * * * *